US007083468B2

(12) United States Patent
Walker et al.

(10) Patent No.: US 7,083,468 B2
(45) Date of Patent: Aug. 1, 2006

(54) STACKED ELECTRICAL CONNECTOR ASSEMBLY

(75) Inventors: Kevin E. Walker, Hershey, PA (US); James H. Hyland, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/843,884

(22) Filed: May 11, 2004

(65) Prior Publication Data

US 2005/0255745 A1 Nov. 17, 2005

(51) Int. Cl.
*H01R 13/60* (2006.01)

(52) U.S. Cl. ..... 439/541.5; 439/607

(58) Field of Classification Search ..... 439/540.1, 439/541.5, 607, 676
See application file for complete search history.

(56) References Cited

U.S. PATENT DOCUMENTS 6,120,321 A * 9/2000 Wu ..... 439/541.5
6,159,039 A * 12/2000 Wu ..... 439/541.5
6,162,089 A 12/2000 Costello et al.
6,474,999 B1 * 11/2002 Givens et al. ..... 439/76.1
6,478,610 B1 * 11/2002 Zhou et al. ..... 439/490
6,520,799 B1 2/2003 Cheng et al.
6,540,563 B1 * 4/2003 Hu et al. ..... 439/676
6,786,772 B1 * 9/2004 Liu ..... 439/620

* cited by examiner

*Primary Examiner*—Thanh-Tam Le
(74) *Attorney, Agent, or Firm*—Wei Te Chung

(57) ABSTRACT

A stacked electrical connector assembly (100) mounted on a main printed circuit board includes an insulative housing (1), an array of USB and modular conductive terminals (24, 222) received in the housing, and a metal outer shell (5) substantially surrounding the insulative housing. The housing defines a USB plug-receiving cavity (101) and a modular plug-receiving cavity (102) stacked beneath the USB plug-receiving cavity. The USB conductive terminals (24) have USB contacting portions (242) exposed in the USB plug-receiving cavity adapted for mating with a USB type plug. The modular conductive terminals (222) have modular contacting portions (223) disposed in the modular plug-receiving cavity adapted for mating with an RJ type plug.

7 Claims, 10 Drawing Sheets

STACKED ELECTRICAL CONNECTOR ASSEMBLY

BACKGROUND OF THE INVENTION

1. Field of the Invention

The present invention relates to an electrical connector and more particularly, to a stacked LAN connector assembly mounted to an apparatus such as a desktop type personal computer, a server and a game machine or the like and mated with a modular plug corresponding thereto.

2. Description of the Prior Art

Modular jack receptacle connectors and Universal Serial Bus (USB) connectors are commonly used the computers or network appliance as input/output ports for transmitting data or signals. An example of such a connector is disclosed in U.S. Pat. No. 6,162,089 issued to Costello et al. on Dec. 19, 2000 which describes a stacked LAN connector. The Costello connector includes a stacked USB component and a modular jack component secured in respective portions of main housing, an outer shield; around the main housing and an inner shield surrounding the stacked USB component. The USB component is stacked beneath the modular jack component. The inner shield includes a front shield having a plurality of grounding legs and a rear shield attached to the front shield.

However, it is difficult to accurately insert or pull out a USB plug if a modular plug has mated with the modular jack component since the USB component is arranged beneath the modular jack component. Moreover, high frequency transmission requires EMI shielding and crosstalk protection between modular jack and USB connectors in order to improve quality of transmission. Furthermore, the structure of the Costello connector is obviously complicated and the cost of the connector is thus relatively high. Furthermore, the inner shield is relatively large for forming the grounding legs in addition when used in stacked modular jack application and the assemble process is complicated. The mounting process and ground connection become more complicated when more ports are integrally made as an assembly.

Hence, an improved electrical connector incorporating electrical connectors of different types and providing good signal transmitting quality is desired to overcome the foregoing shortcomings.

BRIEF SUMMARY OF THE INVENTION

A main object of the present invention is to provide a stacked electrical connector assembly adapted to be facilely and reliably mated with a complementary connector.

Another object of the present invention is to provide a stacked electrical connector assembly with a reliable EMI shielding.

A further object of the present invention is to provide a stacked electrical connector assembly having a middle shell for simplifying the manufacture and reducing cost.

A stacked electrical connector assembly mounted on a main printed circuit board (PCB not shown) includes an insulative housing, an array of conductive USB and modular terminals received in the housing and a metal outer shell substantially surrounding the insulative housing. The housing defines a USB plug-receiving cavity and a modular plug-receiving cavity stacked beneath the USB plug-receiving cavity. The array of USB terminals have USB contacting portions exposed in the USB plug-receiving cavity adapted for mating with a USB type plug. The array of modular terminals have moldular contacting portions disposed in the modular plug-receiving cavity adapted for mating with an RJ type plug.

Other objects, advantages and novel features of the invention will become more apparent from the following detailed description when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the following figures:

DETAILED DESCRIPTION OF THE INVENTION

Figure 1:
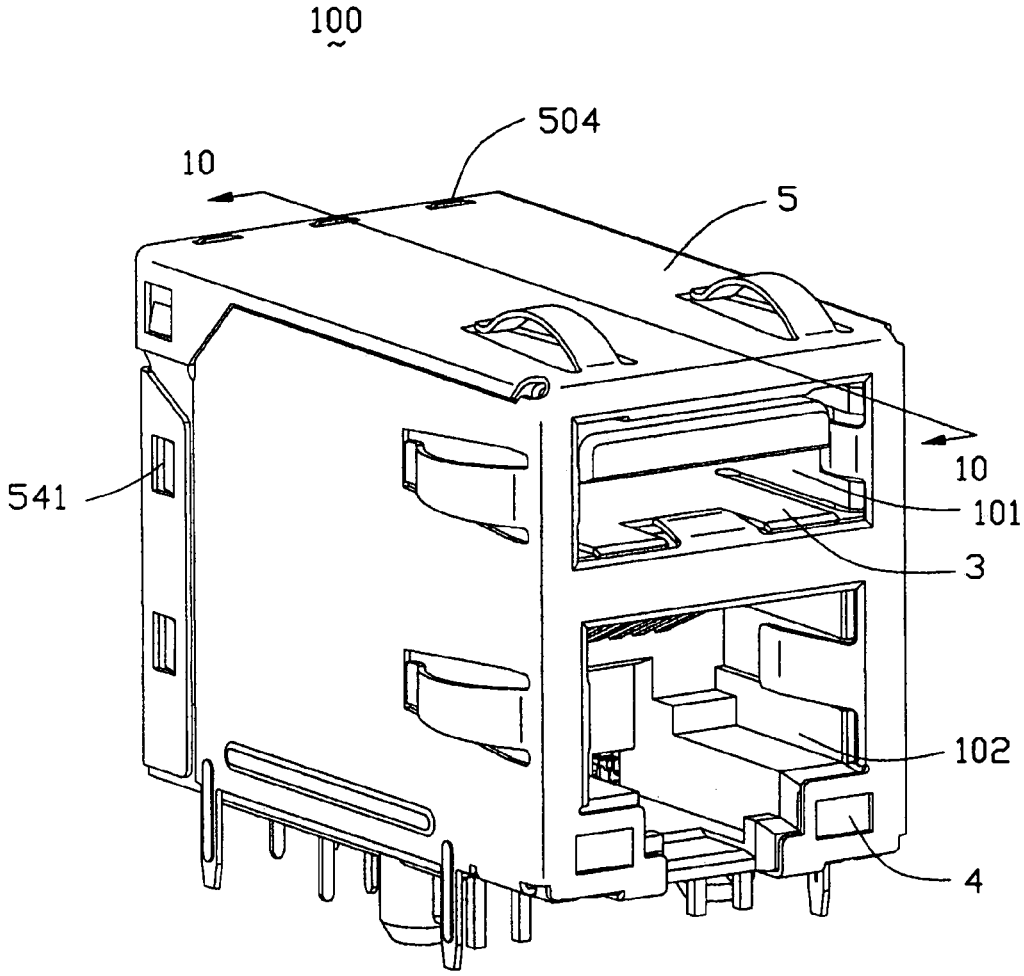
FIG. 1 is a perspective view of a stacked electrical connector assembly according to the present invention.

Reference will now be made to the drawing figures to describe the present invention in detail and first to FIGS. 1, 2 and 3, a stacked connector assembly 100 of the present invention mounted on a main printed circuit board (PCB, not shown) has a mating face (not labeled) provided with a first plug-receiving cavity and a second plug-receiving cavity stacked beneath the first plug-receiving cavity. In the embodiment illustrated, the first plug-receiving cavity is a USB plug-receiving cavity 101 for receiving USB type connectors, while the second plug-receiving cavity is a modular plug-receiving cavity 102 for receiving an RJ type connector. Therefore, customers can easily and accurately insert or pull out USB plugs, since the USB plug-receiving cavity is stacked over the modular plug-receiving cavity 102. However, it is noted that the present invention can be applied to connectors other than these types. The stacked connector assembly 100 includes an insulative housing 1, an insert module 2 received in the housing 1, a middle shell 3, a pair of light emitting diodes (LEDs) 4 and an outer shell 5 substantially surrounding and shielding the housing 1.

Figure 4:
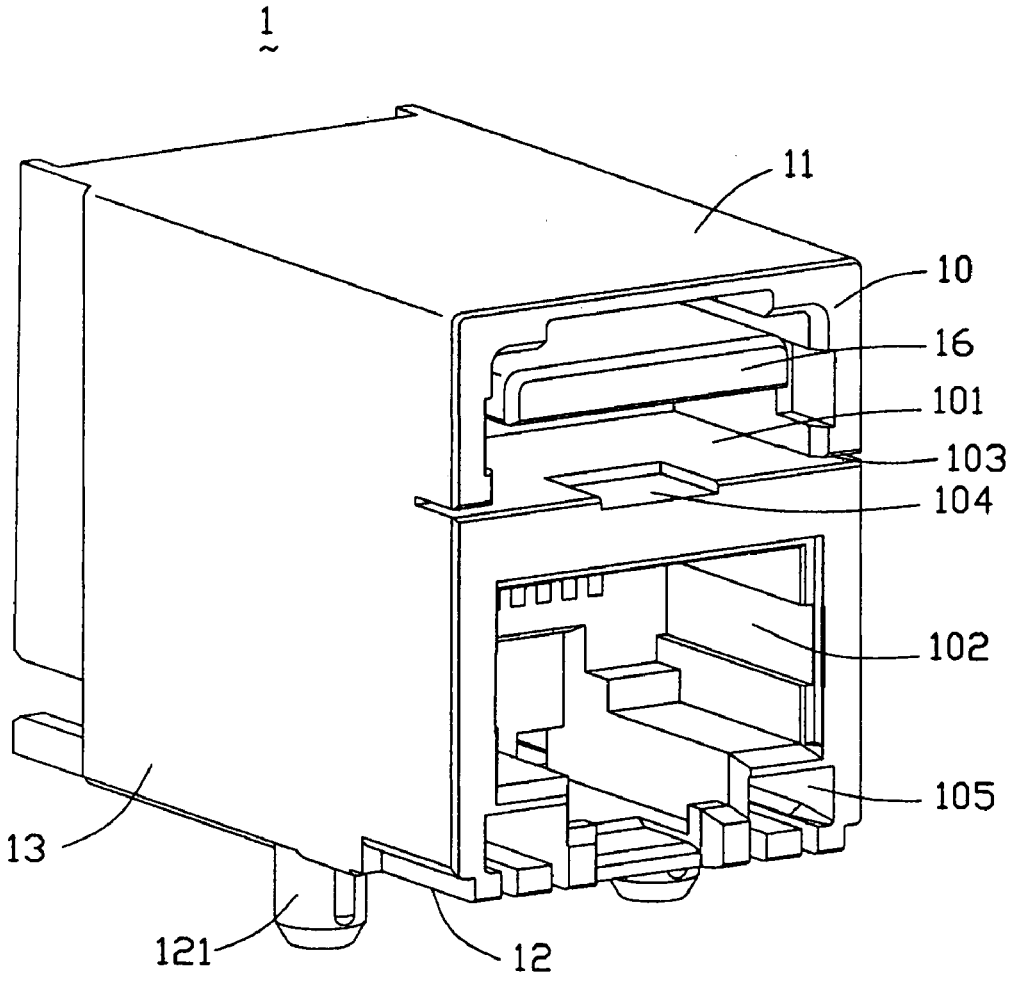
FIG. 4 is a perspective view of an insulative housing in FIG. 2.
Figure 5:
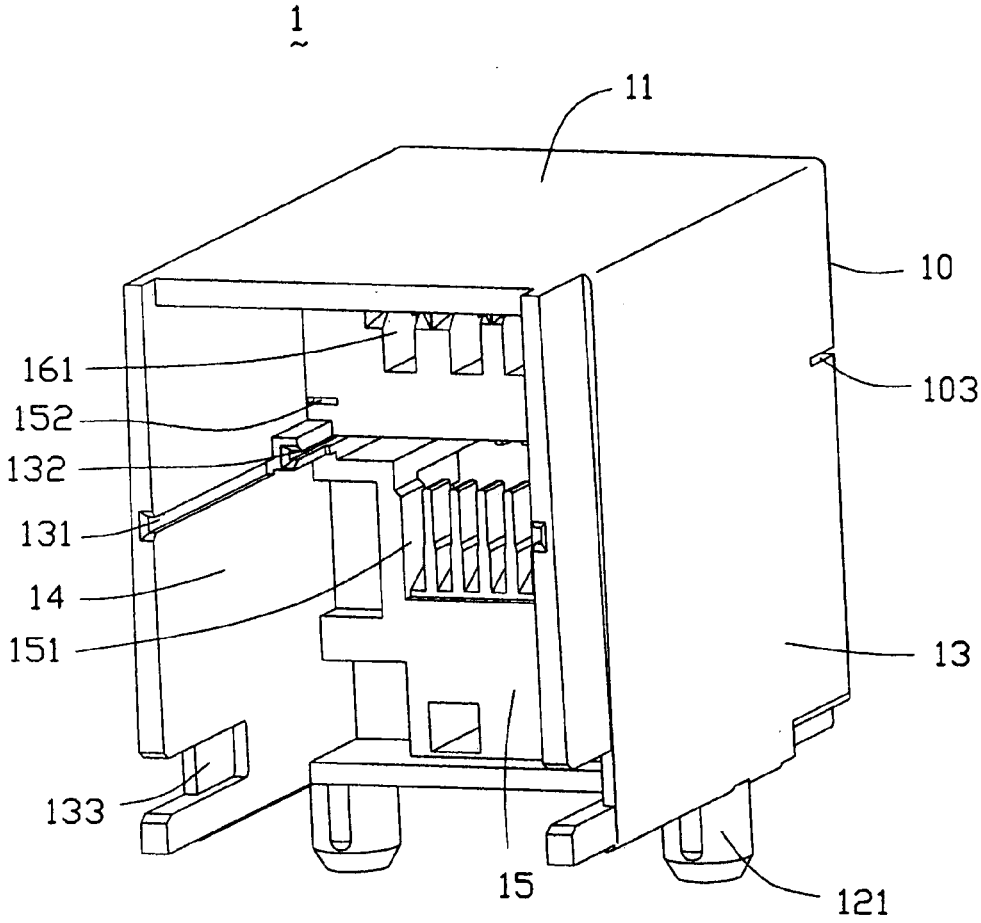
FIG. 5 is another perspective view of the insulative housing in FIG. 3.

As best shown in FIGS. 4 and 5, the insulative housing 1 is a one-piece structure unitarily molded of dielectric material such as plastic or the like. The housing 1 includes a front wall 10, an upper wall 11, a bottom wall 12 and a pair of sidewalls 13 extending rearwardly and connecting the upper wall 11 to the bottom wall 12, thereby forming a rear space 14 for receiving the insert module 2. The front wall 10 provides the USB plug-receiving cavity 101 and the modular plug-receiving cavity 102 extending rearwardly thereinto. The rear space 14 shares a dividing wall 15 with the USB plug-receiving cavity 101 and the modular plug-receiving cavity 102.

A molded protrusion 16 projects forwardly from the dividing wall 15 into the USB plug-receiving cavity 101. A cavity 104 is defined in a middle bottom face of the USB plug-receiving cavity 101. A plurality of passageways 161 (best shown in FIG. 10) are defined in a bottom face of the molded protrusion 16 and extend through the dividing wall 15. A pair of slots 103 are defined in a front bottom face of the USB plug-receiving cavity 101 and extend through the opposite sidewalls 13 for positioning the middle shell 3, which will be discussed later. The front wall 10 further defines a pair of LED mounting cavities 105 in a lower portion thereof for receiving the LEDs 4. The dividing wall 15 defines a plurality of comb passages 151 communicating the modular plug-receiving cavity 102 with the rear space 14, and a pair of slits 152 communicating with the USB plug-receiving cavity 101 for fixing the middle shell 3. Each sidewall 13 defines a rabbet 131 in a middle inner side surface thereof, a retention groove 132 aligned with the rabbet 131, and a notch 133 in a rear bottom portion thereof for engaging with the insert module 2, as will be more fully discussed. The bottom wall 12 has a pair of posts 121 projecting downwardly for engaging with counterparts of the main PCB to accurately position the connector assembly 100 on the main PCB.

With reference to FIGS. 6-9, the insert module 2 comprises a magnetic module 20, a subassembly 22 positioned on the magnetic module 20, a grounding contact 23 mounted on the magnetic module 20 and a plurality of first conductive terminals 24 fixed in a rear portion of the magnetic module 20.

The magnetic module 20 includes an insulative base 21, a plurality of upper contacts 201 mounted on an upper portion of the base 21 for connecting with the subassembly 22, a plurality of lower contacts 202 mounted on a bottom portion of the base 21 for connecting with the main PCB, and a plurality of magnetic coils 203 interconnecting the upper and lower contacts 201, 202. The insulative base 21 defines a forwardly-opening chamber 211 for installing the magnetic coils 203, and a plurality of rearwardly-opening grooves 213 for receiving the first conductive terminals 24. A pair of molded bosses 212 project outwardly from rear lower portions of opposite side surfaces of the base 21 for engaging with the notches 133 of the housing 1. The base 21 further provides a recess 214 beneath one of the molded bosses 212 for fixing the grounding contact 23 and a pair of projections 215 on an upper face thereof for engaging with the subassembly 22.

The subassembly 22 comprises an internal PCB 221 with a plurality of signal conditioning components (not labeled), such as resistors, capacitors or inductors, and a plurality of second conductive terminals 222 mounted thereon. In the preferred embodiment, the first and second conductive terminals 24, 222 are respectively provided for mating with the USB type and modular type plugs. For convenience, such first and second conductive terminals 24, 222 are referred hereafter as USB and modular terminals 24, 222. The modular terminals 222 are mounted on a front portion of the internal PCB 221 and have modular contacting portions 223 angled downwardly from a front end of the subassembly 22. The internal PCB 221 includes a plurality of mounting holes 224 in a middle portion for receiving the upper contacts 201 therein, a pair of retention beams 225 arranged on opposite sides of the modular terminals 222 for receiving in the retention groove 132 of the housing to positioning and guiding the modular terminals 222, a pair of through holes 226 for engaging with the projections 215 of the magnetic module 20 and a grounding hole 227 for receiving the grounding contact 23 therein.

The grounding contact 23 includes a first vertical beam 231, a horizontal beam 232 extending forwardly from a bottom end of the first vertical beam 231, and a second vertical beam 233 extending downwardly from a front end of the horizontal beam 232.

Each USB terminal 24 includes a vertical portion 241 and a USB contacting portion 242 extending from an upper portion of the vertical portion 241.

Figure 2:
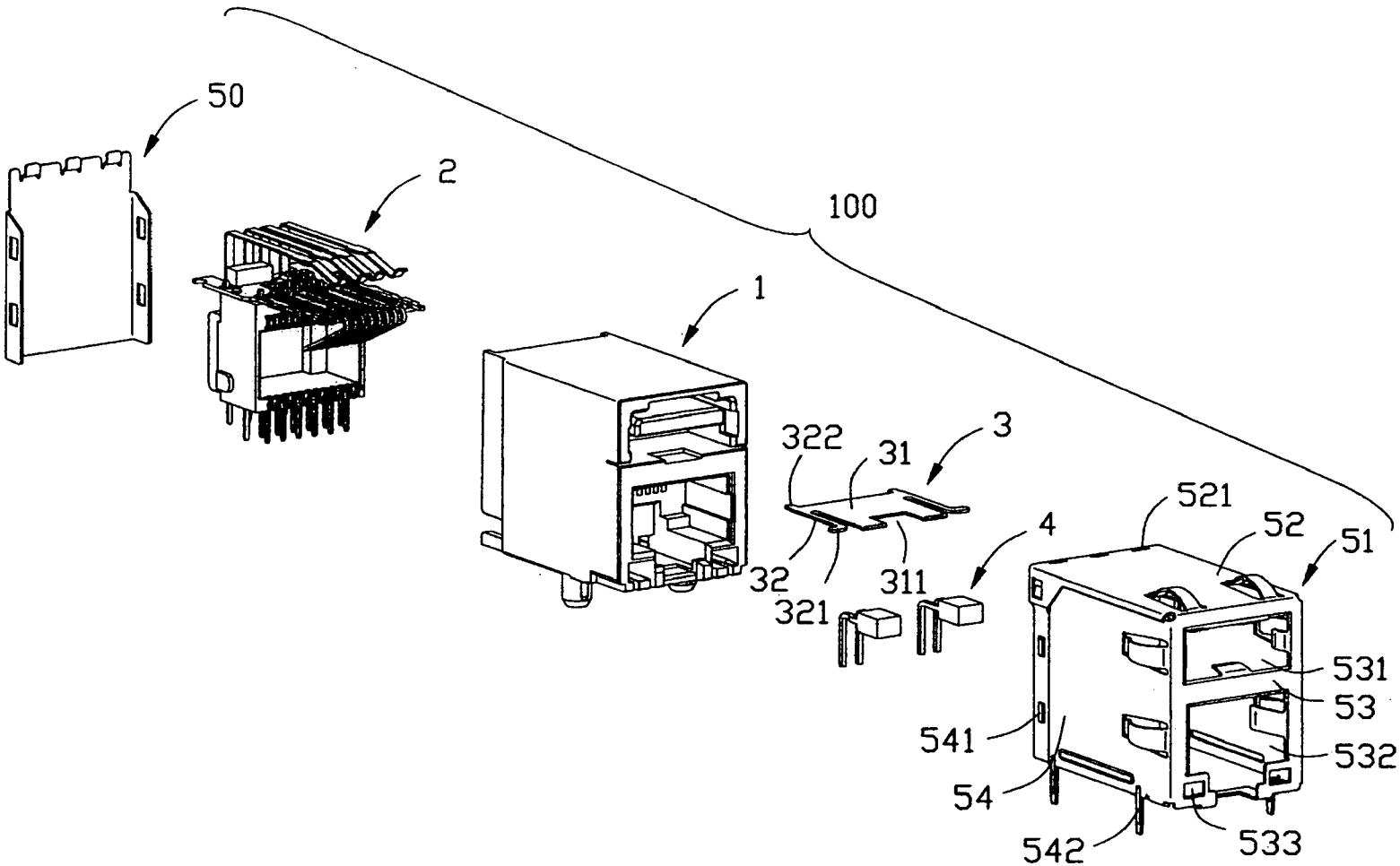
FIG. 2 is an exploded view of FIG. 1.
Figure 3:
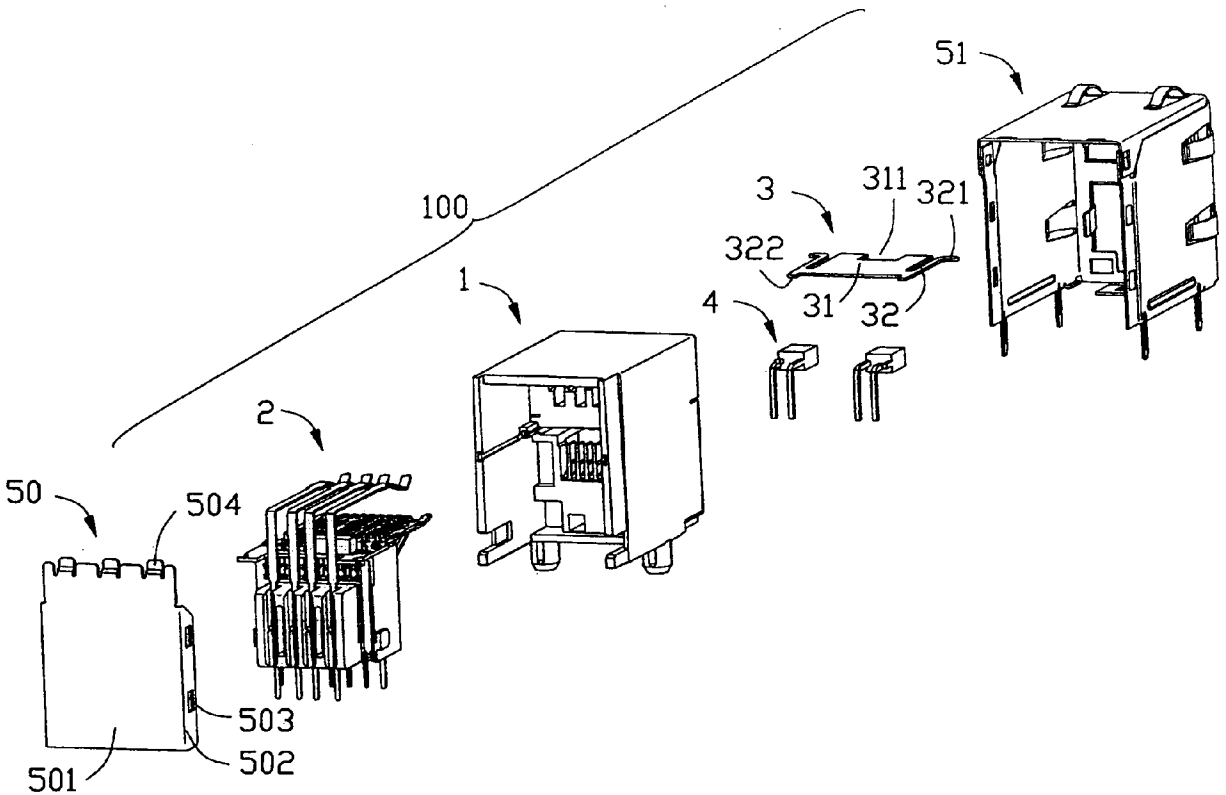
FIG. 3 is another exploded view of FIG. 1.

As best shown in FIGS. 2 and 3, the middle shell 3 is stamped from one metal sheet and includes a body portion 31 and a pair of arms 32 on opposite sides of the body portion 31. The body portion 31 defines a cutout 311 in a front middle portion thereof. A pair of gaps (not labeled) are defined between the arms 32 and the body portion 31. Each arm 32 includes a connecting portion (not labeled) integrally formed with the body portion 31, a contact bump 321 extending outwardly from a front end thereof for electrically contacting with the outer shell 5 and a rear fixing portion 322 extending rearwardly for fitting in a corresponding slit 132 of the housing 1.

The outer shell 5 is stamped from a sheet of conductive material and includes a front shell 51 and a rear shell 50 attached to the front shell 51. The rear shell 50 includes a rear plate 501 and a pair of flaps 502 extending forwardly from opposite sides of the rear plate 501 each defining a number of locking holes 503 therethrough. The rear plate 501 further has a plurality of retention tabs 504 projecting forwardly and upwardly.

The front shell 51 includes an upper plate 52, a front plate 53 and two side plates 54. The upper plate 52 defines a plurality of retention slots 521 on a rear portion thereof for engaging with retention tabs 504 of the rear shell 50. The front plate 53 defines a USB plug-opening 531 and a modular plug-opening 532 corresponding to the USB and modular plug-receiving cavities 101, 102 of the housing 1 respectively, and also a pair of LED-receiving holes 533. Each side plate 54 includes a plurality of locking portions 541 for engaging with the locking holes 503 and a plurality of grounding tails 542 extending downwardly therefrom for connecting with the main PCB.

Figure 6:
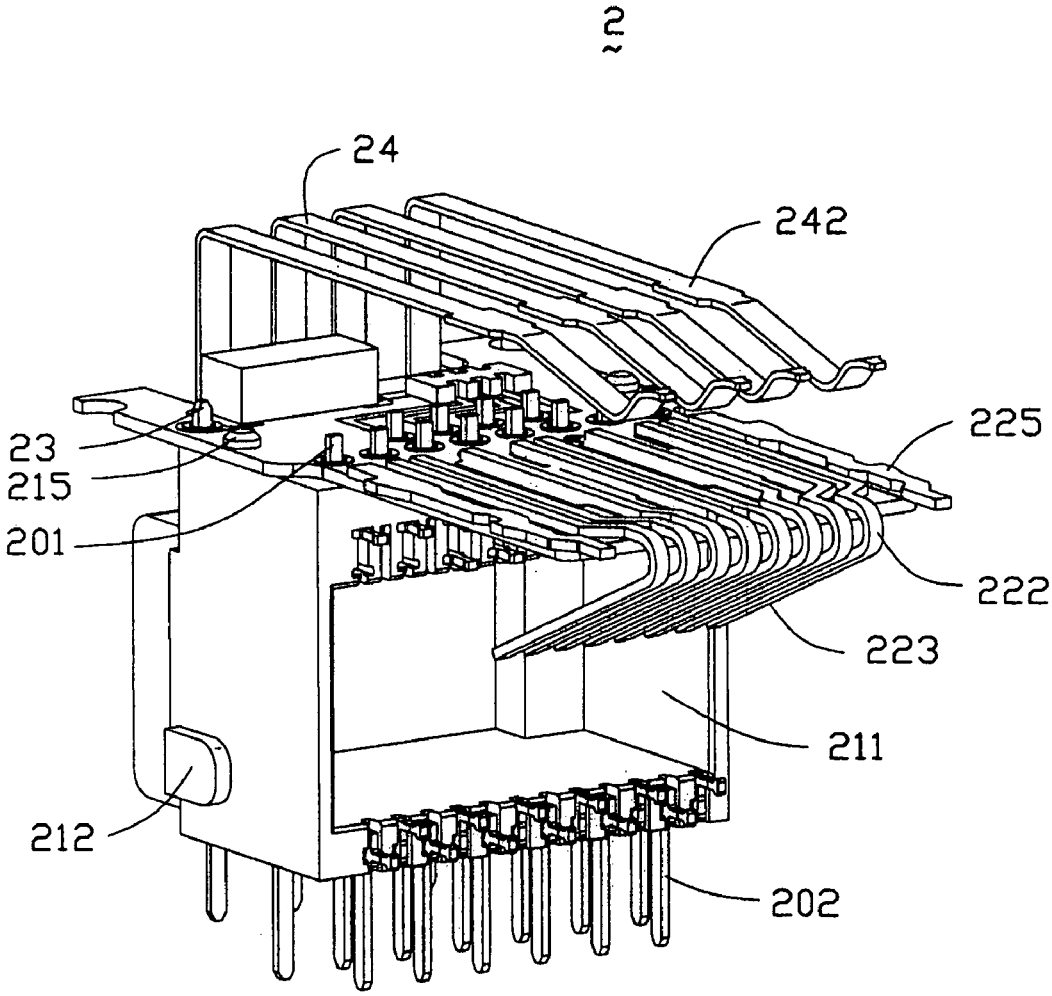
FIG. 6 is a perspective view of an insert module in FIG. 2.
Figure 7:
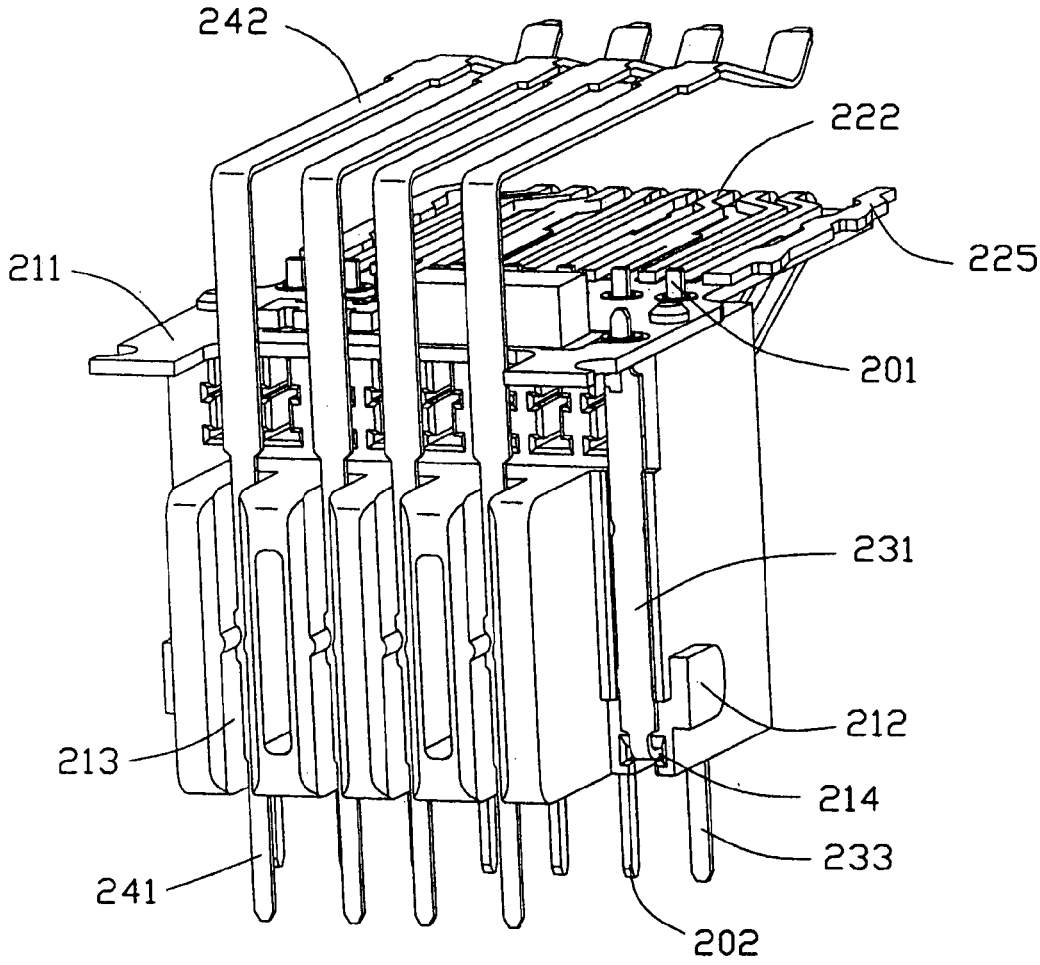
FIG. 7 is another perspective view of the insert module in FIG. 3.
Figure 8:
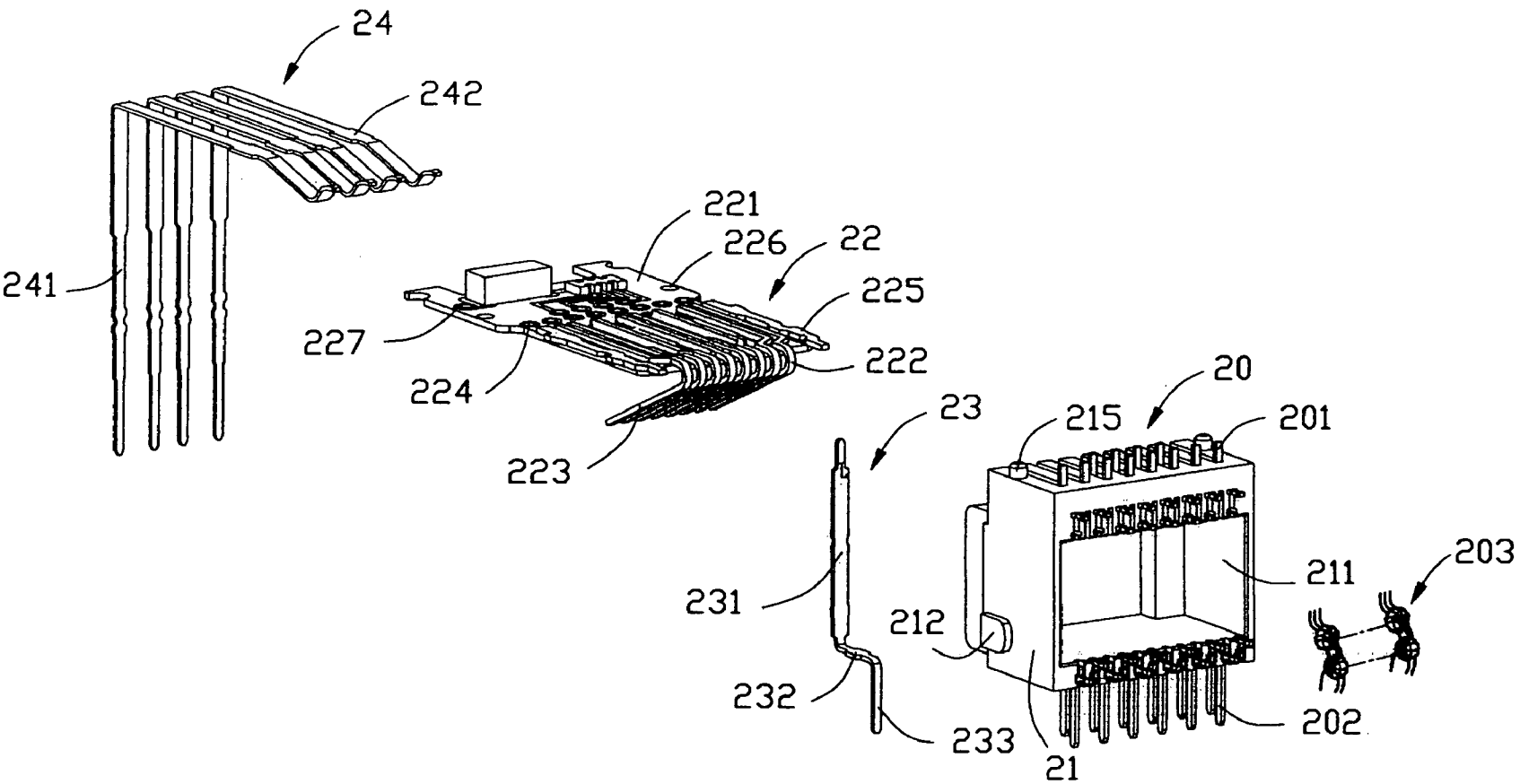
FIG. 8 is an exploded view of FIG. 6.
Figure 9:
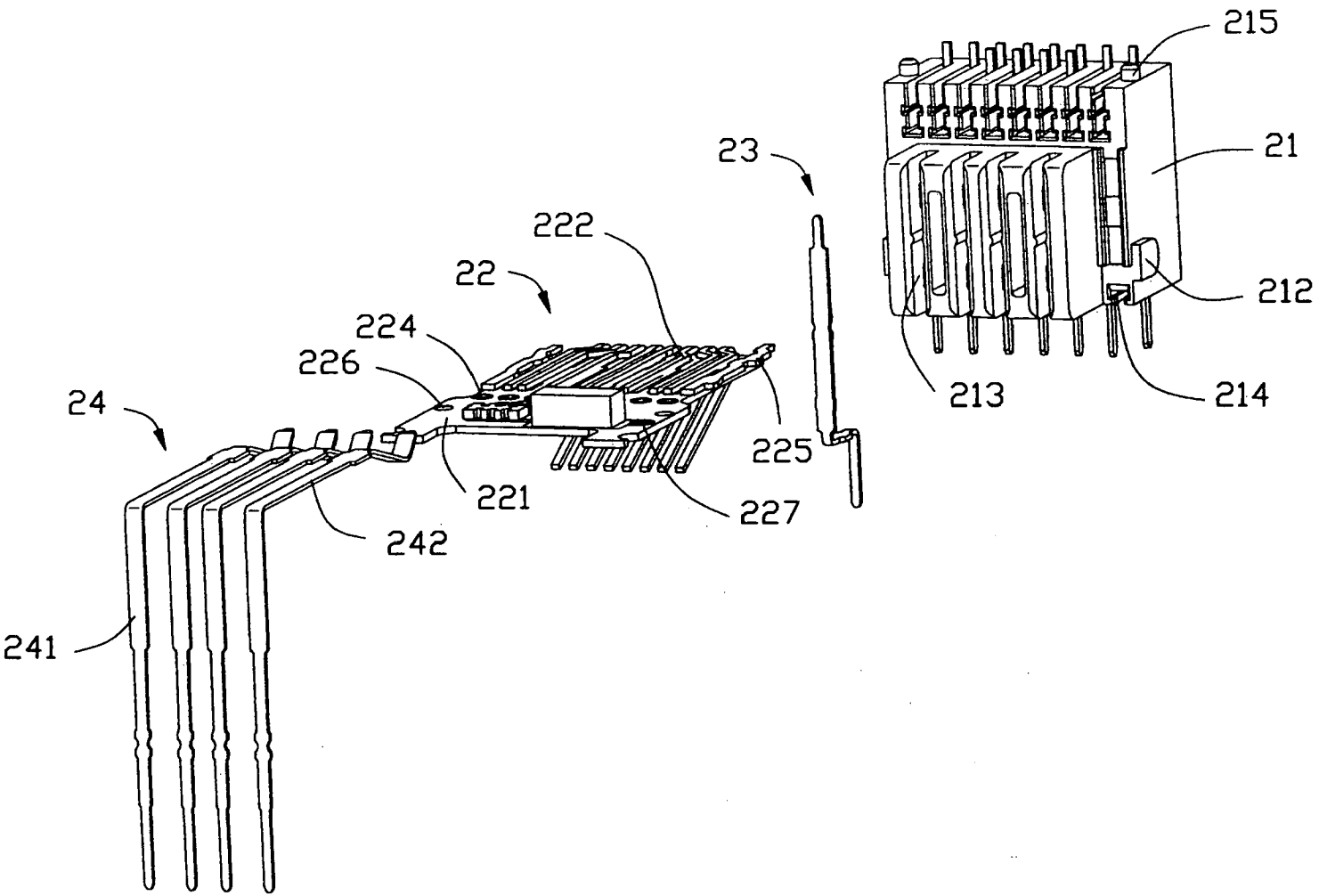
FIG. 9 is another exploded view of FIG. 6.

Referring to FIGS. 6 and 7, in assembly, the first step is to assemble the insert module 2. The grounding contact 23 is embedded in the magnetic module 20. The horizontal beam 232 of the grounding contact 23 is held in the recess 214 of the base 21, the first vertical beam 231 extends upwardly beyond a top surface of the base 21, and the second vertical beam 233 extends downwardly for connecting with a grounding trace of the main PCB. Secondly, the subassembly 22 is assembled to the magnetic module 20. The projections 215 of the base 21 of the magnetic module 20 extend through the through holes 226 of the internal PCB 221 of the subassembly 22, and the upper contacts 201 of the magnetic module 20 extend through corresponding mounting holes 224 and are soldered therein. The first vertical beam 231 of the grounding contacts 23 extends through the grounding hole 227 of the internal PCB 221 and is soldered therein. The USB terminals 24 are assembled to the magnetic module 20 thereafter. The vertical portions 241 of the USB terminals 24 are held in corresponding grooves 213 of the magnetic module 20, and the USB contacting portions 242 upwardly extend beyond the subassembly 22 and are essentially paralleled to the internal PCB 221.

Referring to FIGS. 1–10, the insert module 2 is assembled to the housing 1 into the rear space 14. The internal PCB 221 slides forwardly along the rabbets 131 of the housing 1. The retention beams 225 on the internal PCB 221 are securely retained in the retention grooves 132 of the housing 1. The modular terminals 222 extend through the passages 151 with modular contacting portions 223 exposed in the modular plug-receiving cavity 102. The USB terminals 24 extend through the dividing wall 15 and snugly positioned in the passageways 161 of the molded protrusion 16. The molded bosses 212 of the magnetic module 20 are held in corresponding notches 133 of the housing 1. Therefore, the insert module 2 is securely installed in the housing 1.

Figure 10:
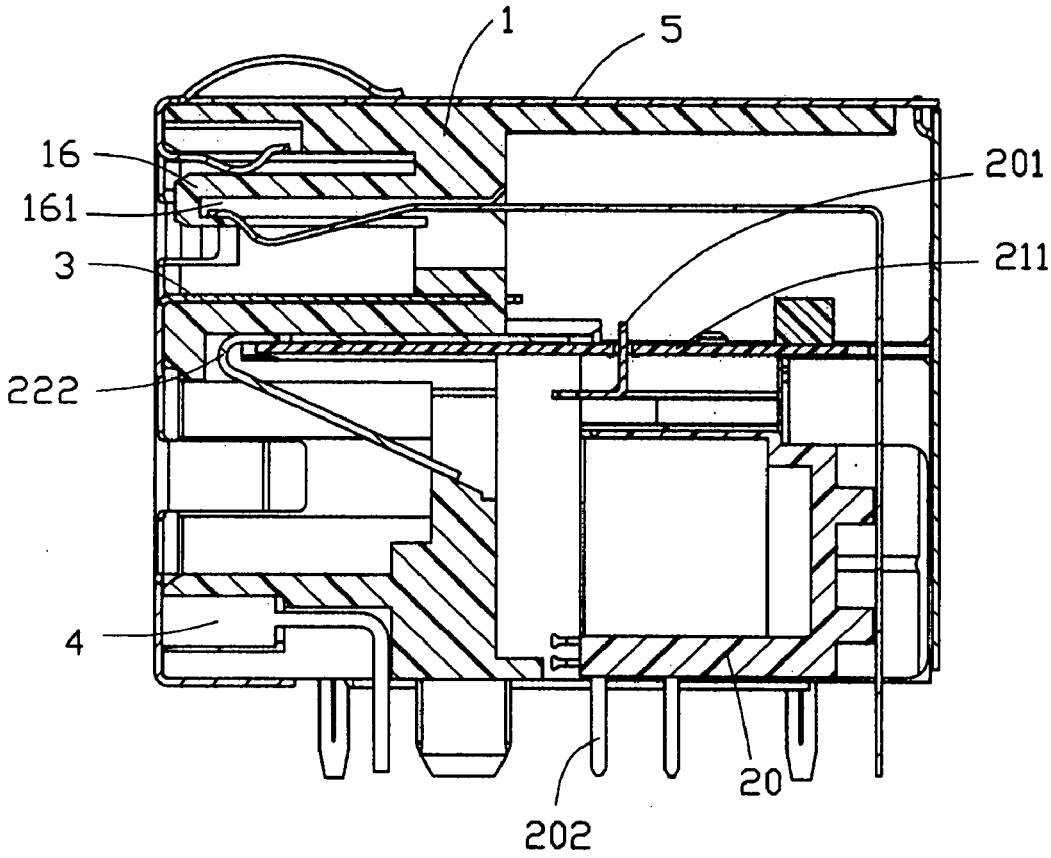
FIG. 10 is a cross-sectional view of FIG. 1 taken along the line 10—10 of FIG. 1.

With reference to FIGS. 2, 3 and 10, the middle shell 3 is inserted into to the housing 1 from the front wall 10. The body portion 31 of the middle shell 3 adheres to the bottom face of the USB plug-receiving cavity 101. The cutout 311 of the middle shell 3 is appropriately apertured to expose the cavity 104. The contact bump 321 of the arms 32 of the middle shell 3 are received in the slots 103 and extend sidewardly beyond the slots 103 for connecting with the outer shell 5. The rear fixing portion 322 are fixed in the slits 152 with a rear end extending beyond the slits 152. The LEDs 4 are mounted in the LED mounting cavities 105 for indicating whether an electrical connection is established or not.

The rear shell 50 is attached to the front shell 51 after the front shell 51 substantially surrounds the housing 1. The front shell 51 envelops the housing 1 with the front plate 53 along the front face 10, and the USB and modular plug-openings 531, 532 are appropriately apertured to expose the USB and modular plug-receiving cavities 101, 102, as such the LEDs 4 extend forwardly through the LED-receiving holes 533. The contact bump 321 of the middle shell 3 respectively abut against the side plates 54, The rear shell 50 is assembled to the front shell 51 with the locking portions 541 received in the locking holes 503 and the retention tabs 504 engaged with the retention slots 521. It should be noted that the housing 1 further defines a plurality of grooves or recesses (not labeled) in the USB and plug-receiving cavities 101, 102, and the outer shell 5 also provides a plurality of retention tabs (not labeled) engaging with the grooves or recesses for securely locking onto the housing 1.

It is important to note that the grounding contact 23, the middle shell 3, the front shell 51 and the rear shell 50 form an integral ground system that establishes the signal integrity characteristic of the connector assembly, whereby EMI from outer environment and crosstalk between the high-speed signals of the terminals and contacts of the stacked connector assembly can be eliminated rapidly and efficiently.

While terms such "front", "rear", "upper", "lower", "vertical" and "horizontal" have been used to help describe the invention as it is illustrated, it should be understood that the stacked electrical connector assembly 100 can be used in any orientation with respect to earth.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly adapted to be mounted on a main circuit board, comprising:

an insulative housing defining a universal serial bus (USB) plug-receiving cavity and a modular plug-receiving cavity-stacked beneath the USB plug-receiving cavity;

an array of conductive USB terminals having USB contacting portions exposed in the USB plug-receiving cavity;

an array of conductive modular terminals having modular contacting portions disposed in the modular plug-receiving cavity;

a metal outer shell substantially surrounding the insulative housing;

an internal circuit board and a magnetic module electrically connecting with the modular terminals via the internal circuit board; and a grounding contact fixed in the insulative base and electrically connecting with the internal circuit board;

wherein the internal circuit board has a plurality of signal conditioning components mounted thereon for reducing or eliminating noise;

wherein the magnetic module includes an insulative base, a plurality of upper contacts arranged on an upper portion of the base for electrically connecting with the internal circuit board, a plurality of lower contacts adapted for connecting with the main circuit board, and a plurality of magnetic coils interconnecting the upper and lower contact; and wherein the grounding contact includes a horizontal beam fixed in the insulative base, a first vertical beam extending upwardly from one end of the horizontal beam to connect with the internal circuit board, and a second vertical beam extending downwardly from the other end of the horizontal beam to connect with the main circuit board.

2. A stacked electrical connector assembly, for engaging with mating plugs, comprising:

an insulative housing including a first and second plug-receiving cavities stacked vertically, a front mating face configured to be allowed to confront the mating plugs and a rear space;

a first array of conductive terminals having first contacting portions exposed in the first plug-receiving cavity;

a second array of conductive terminals, dissimilar from said first terminals, having second contacting portions disposed in the second plug-receiving cavity;

a middle shell disposed between the first and the second array of conductive terminals, the middle shell being rearwardly inserted into the housing from said front mating face the housing and between the first and second plug-receiving cavities in the vertical direction; and an insert module received in the rear space of the housing, the insert module including an internal circuit board connecting with at least one array of the first and second conductive terminals, a magnetic module connecting with the at least one array of first and second conductive terminals via the internal circuit board and a grounding contact electrically connecting with the internal circuit board.

3. The stacked electrical connector assembly according to claim 2, wherein the first plug-receiving cavity is stacked over the second plug-receiving cavity, and wherein the first array of conductive terminals are adapted to mate with a USB type plug, and the second array of conductive terminals are adapted to mate with a modular type plug.

4. The stacked electrical connector assembly according to claim 3, wherein the second array of conductive terminals are mounted on the internal circuit board and electrically connect with the magnetic module.

5. The stacked electrical connector assembly according to claim 2, wherein the magnetic module includes an insulative base, a plurality of upper contacts and lower contacts mounted on the base, and a plurality of magnetic coils interconnecting the upper and lower contacts.

6. The stacked electrical connector assembly according to claim 2, further including a metal outer shell surrounding the housing.

7. A stacked electrical connector assembly comprising:

an insulative housing defining first and second receiving cavities, respectively in a vertical direction;

an insert module attached to a rear portion of the housing, said insert module including a magnetic module and a printed circuit board attached to said magnetic module, a plurality of first contacts attached to the printed circuit board and extending into the first cavity; and a plurality of second contacts retained by said magnetic module and extending into the second cavity but spaced from the printed circuit board; wherein the number and the configuration of the first contacts are dissimilar from those of the second contacts the insert module is inserted into the forwardly from the rear portion of the housing, while an inner shield is rearwardly inserted into the housing from a front face of the housing and between the first and second cavity in the vertical direction, and the second cavity is located above the first cavity.

* * * * *